US008774990B2

(12) United States Patent
Burg et al.

(10) Patent No.: US 8,774,990 B2
(45) Date of Patent: Jul. 8, 2014

(54) METHOD FOR DEMANDING SAFETY REACTIONS FOR A RAIL VEHICLE

(75) Inventors: Wilhelm Burg, Sacramento, CA (US); Norbert Werkmeister, Kempen (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 12/915,117

(22) Filed: Oct. 29, 2010

(65) Prior Publication Data

US 2011/0093142 A1 Apr. 21, 2011

(30) Foreign Application Priority Data

Jan. 10, 2008 (DE) ..... 10 2008 027 520

(51) Int. Cl.
*B60T 8/17* (2006.01)
*G06F 19/00* (2011.01)
*B61H 13/00* (2006.01)

(52) U.S. Cl.
USPC ..... 701/19; 701/20; 701/70; 701/71; 701/75; 701/76; 701/78; 701/82; 701/83; 246/4; 246/5; 246/167 R; 246/187 R; 303/3; 303/7; 303/15; 303/122; 303/122.01

(58) Field of Classification Search
USPC ..... 701/19, 20, 70, 71, 75, 76, 78, 82, 83; 246/4, 5, 20, 167 R, 187 R, 186; 303/3, 303/7, 2, 15, 20, 122, 122.01, 122.09
See application file for complete search history.

(56) References Cited

U.S. PATENT DOCUMENTS

| | | | | | |
|---|---|---|---|---|---|
| 4,683,537 | A | * | 7/1987 | Matsuda | 701/79 |
| 5,088,042 | A | * | 2/1992 | Brearley et al. | 701/70 |
| 5,099,443 | A | * | 3/1992 | Higashimata et al. | 702/141 |
| 5,286,096 | A | * | 2/1994 | Ferri et al. | 303/15 |
| 5,315,520 | A | * | 5/1994 | Drake et al. | 701/20 |
| 5,551,765 | A | * | 9/1996 | Sich | 303/7 |
| 5,791,744 | A | * | 8/1998 | Wood et al. | 303/7 |
| 5,835,873 | A | * | 11/1998 | Darby et al. | 701/45 |

(Continued)

FOREIGN PATENT DOCUMENTS

| | | | | |
|---|---|---|---|---|
| DE | 3209157 | A1 | 9/1983 | |
| DE | 10026836 | C1 | 2/2002 | |
| EP | 978434 | A1 * | 2/2000 | B60T 13/66 |
| GB | 1345955 | A | 2/1974 | |

OTHER PUBLICATIONS

European Search Report dated Jul. 28, 2010.

*Primary Examiner* — Thomas Black
*Assistant Examiner* — Sara Nelson
(74) *Attorney, Agent, or Firm* — Laurence A. Greenberg; Werner H. Stemer; Ralph E. Locher

(57) ABSTRACT

A method for demanding safety reactions for a rail vehicle having a plurality of appliances each able to demand a safety reaction when required, namely a braking process or a traction inhibit or both for the rail vehicle, includes:

a) identification of a state in which one of the safety reactions should be carried out by one of the appliances,
b) demanding the safety reaction by the appliance through a data bus, and
c) feeding back information to the demanding appliance that the safety reaction has been carried out or intervening in a safety loop to initiate the desired safety reaction, if the safety reaction is not carried out.

11 Claims, 1 Drawing Sheet

(56) References Cited

U.S. PATENT DOCUMENTS

| | | | | |
|---|---|---|---|---|
| 6,024,419 | A * | 2/2000 | Waldrop et al. | 303/3 |
| 6,314,358 | B1 * | 11/2001 | Dorn et al. | 701/70 |
| 6,991,301 | B2 * | 1/2006 | Aurich et al. | 303/15 |
| 7,036,774 | B2 * | 5/2006 | Kane et al. | 246/167 R |
| 7,209,811 | B1 * | 4/2007 | Goricke et al. | 701/19 |
| 7,722,134 | B2 * | 5/2010 | Kane | 303/128 |
| 2003/0043739 | A1 * | 3/2003 | Reinold et al. | 370/228 |
| 2004/0036351 | A1 * | 2/2004 | Mayer et al. | 303/139 |
| 2004/0186648 | A1 * | 9/2004 | Zheng et al. | 701/70 |
| 2005/0125131 | A1 * | 6/2005 | Kato et al. | 701/70 |
| 2005/0278107 | A1 * | 12/2005 | Disser et al. | 701/76 |
| 2006/0108867 | A1 * | 5/2006 | Ralea | 303/152 |
| 2006/0190158 | A1 * | 8/2006 | Shiiba et al. | 701/70 |
| 2008/0091326 | A1 * | 4/2008 | Watanabe et al. | 701/70 |
| 2008/0143178 | A1 * | 6/2008 | Wiesand | 303/122.05 |
| 2008/0288147 | A1 * | 11/2008 | Cesario et al. | 701/70 |
| 2008/0309156 | A1 * | 12/2008 | Kissel | 303/20 |

* cited by examiner

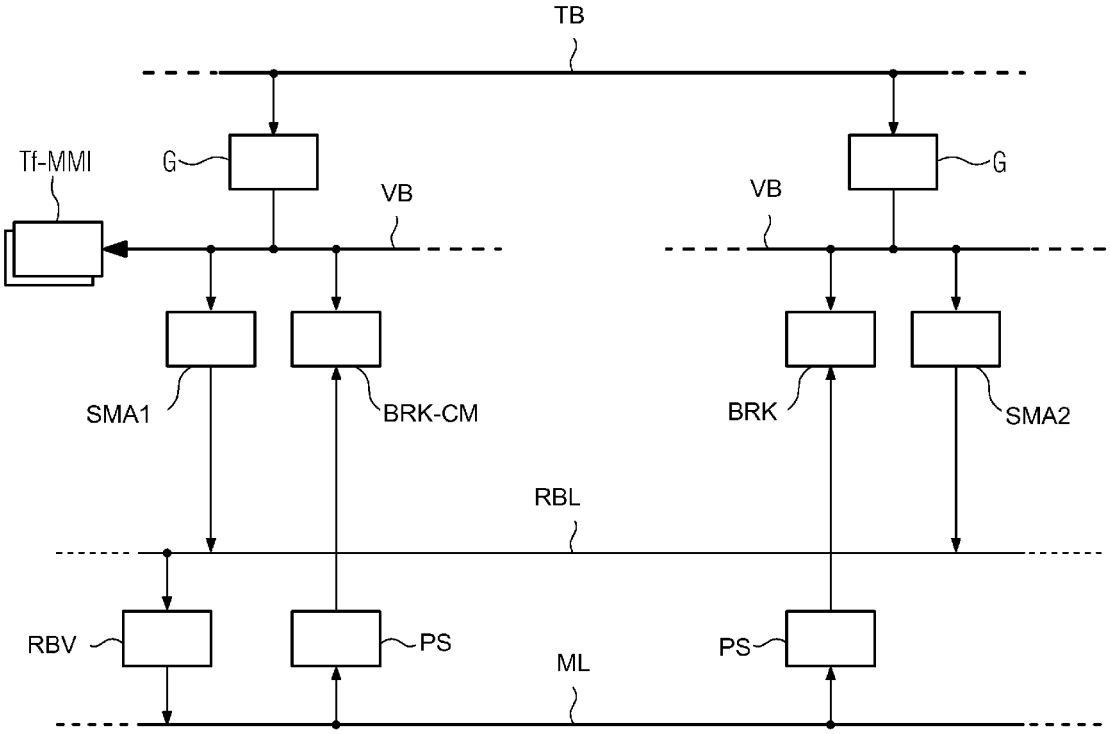
TB
Tf-MMI
G
VB
VB
G
SMA1
BRK-CM
BRK
SMA2
RBL
RBV
PS
ML
PS

METHOD FOR DEMANDING SAFETY REACTIONS FOR A RAIL VEHICLE

BACKGROUND OF THE INVENTION

Field of the Invention

The invention relates to a method for initiating safety reactions of a rail vehicle having a plurality of appliances or devices which can each demand or request a braking process or inhibit traction for the rail vehicle when required.

Emergency or rapid braking actions and traction inhibits are normally demanded through hard-wired safety loops in rail vehicles. Alternatively, it is possible to intervene directly for a braking demand in a main air line through which the rail vehicle brakes are operated.

The demands for emergency or rapid braking or a traction inhibit can originate from various appliances or functions within the rail vehicle. Examples thereof are the operating control technology, the passenger emergency brake, various bogie truck or wagon monitoring functions, "Sifa" (safety driving switch, which is also referred to as a dead-man switch), braking controllers (for example in the event of brakes being incorrectly applied), doors (green loop), maximum speed monitoring, etc. Braking demands can also be initiated by a locomotive engineer.

Individual safety loops are in each case or in some cases incorporated in the rail vehicle for various appliances/systems. The various safety loops are required in order to map the various functional demands of the various appliances/systems. By way of example, demands such as those include whether it should or should not be possible for a locomotive engineer to cancel the demands, whether full braking or rapid braking, or only a traction inhibit should be implemented, whether braking should be carried out immediately or with a time delay, whether braking should be carried out to rest or to only a defined speed, whether an automatic vehicle reaction should take place or the demand should be passed to the locomotive engineer, with the aim of him or her carrying out the reaction, etc. Individual safety loops are also provided for the reason that, if required, such as emergency running or a false alarm, etc., the respective safety loop can be bridged/deactivated by fault switches without adversely affecting the other safety loops. That ensures high availability and safety of the braking system.

Due to the current configuration of the method, in particular of the hardware equipment that is used for it, there are currently numerous safety loops alongside one another, and therefore a high degree of wiring complexity in the rail vehicles and in the couplings, with corresponding costs and heavy weight. Furthermore, there is the complexity of the electrical power supply and monitoring/diagnosis of the safety loops, and of contactors and switches involved in implementation of the method.

In addition, in most cases, a respective appliance initiates rapid braking for safety reasons in the event of a braking demand, resulting in increased wear.

SUMMARY OF THE INVENTION

It is accordingly an object of the invention to provide a method for demanding safety reactions for a rail vehicle, which overcomes the hereinafore-mentioned disadvantages of the heretofore-known methods of this general type and which requires comparatively few safety loops.

With the foregoing and other objects in view there is provided, in accordance with the invention, a method for demanding safety reactions for a rail vehicle. The method comprises providing a plurality of appliances each configured to demand a safety reaction selected from the group consisting of a braking process, a traction inhibit and both a braking process and a traction inhibit for the rail vehicle when required, as follows:

a) identifying a state in which one of the safety reactions should be carried out by one of the appliances;

b) demanding the safety reaction by the appliance over a data bus; and c) either feeding back information to the demanding appliance that the safety reaction has been carried out or intervening in a safety loop to initiate a desired safety reaction if the safety reaction has not been carried out.

In this case, the safety loop is in the form of a rapid braking loop when a braking process is demanded, and a traction inhibit loop when a traction inhibit is demanded.

In this case, it can be stated that the various functional demands and the individual capability for bridging are implemented by communication through a data bus, thus making it possible to save individual safety loops. A safety loop is now required only to provide a reversionary level, that is to say in cases in which confirmation that a demanded braking process or a demanded traction inhibit has been successfully carried out is not suitably fed back, for whatever reason.

In accordance with another mode of the invention, in step b), low-wear full braking is normally demanded in the event of a braking demand, as a result of which the normal demand in the prior art for rapid braking through an associated safety loop can be avoided as far as possible.

In accordance with a further mode of the invention, in step c), a braking process that is carried out can be fed back in various ways. By way of example, a train speed value, a measured pressure value of a main air line of the rail vehicle, a signal from a braking control system for the rail vehicle or a combination thereof can be passed to the appliance demanding the braking process. It is evident to a person skilled in the art that a reduction in the pressure in the main air line or a reduction in the train speed is directly related to a braking process having been successfully carried out. It is within the area of skill of a person skilled in the art as to which respective suitable threshold value should be the significant factor in this case for a reduction in the pressure or the speed.

In accordance with an added mode of the invention, the feedback of a traction inhibit carried out in step c) can also be provided in various ways. For example, a train speed value or a signal from a drive control system can be passed to the appliance demanding the traction inhibit.

In accordance with a concomitant mode of the invention, in a suitable manner, in step c), a predefined time period from the demand for braking or demand for traction inhibit is defined for the feedback of a braking process carried out or a traction inhibit carried out, and the intervention in the safety loop takes place if there is no feedback to the appliance within the predefined time period. This particularly advantageously implements the use of the safety loop as a reversionary level for carrying out a braking process or a traction inhibit when there is no feedback to the appliance demanding the braking process or the traction inhibit.

Other features which are considered as characteristic for the invention are set forth in the appended claims.

Although the invention is illustrated and described herein as embodied in a method for demanding safety reactions for a rail vehicle, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawing.

BRIEF DESCRIPTION OF THE DRAWING

The FIGURE is a block diagram of an architecture for controlling positive braking actions in a rail vehicle.

DETAILED DESCRIPTION OF THE INVENTION

Referring now in detail to the single FIGURE of the drawing, there is seen, by way of example, two safety monitoring appliances SMA1, SMA2, one of which is intended to demand positive braking when a situation representing a safety risk is identified.

In this case, the safety monitoring appliance SMA1 demands full braking through a vehicle bus VB from a central braking manager BRK-CM. The central braking manager BRK-CM initiates full braking of the rail vehicle. When the safety monitoring appliance SMA1 demanding the braking does not receive feedback about the successful initiation of full braking within a defined time period, the safety monitoring appliance SMA1 opens a rapid braking loop RBL, in order to safely carry out positive braking, which has not been carried out for whatever reasons. The rapid braking loop RBL vents a main air line ML through a rapid braking valve RBV, leading to rapid braking. The feedback about the initiation of full braking is provided in this case, by way of example, through the feedback from the braking controllers including the central braking manager BRK-CM and a braking manager BRK, which monitor a pressure reduction in the main air line ML through pressure sensors PS. Alternatively, a train speed can also be monitored with the aid of suitable sensors, the feedbacks of which are then passed to the demanding safety monitoring appliance SMA1.

All of the above-mentioned controllers, which in the example are the safety monitoring appliances SMA1, SMA2 and the braking controllers BRK-CM, BRK, are connected to one another through the vehicle bus VB, for communication purposes. The individual vehicle buses VB are connected to a train bus TB through respective gateways G.

It should be stressed that not only the safety monitoring appliance SMA1 but also all of the other suitable controllers in the rail vehicle can each demand positive braking or a traction inhibit if required, and can then also be responsible for monitoring the required feedback that the positive braking or possibly the traction inhibit has been carried out, through the vehicle bus VB, the train bus TB, conventional signal lines or any other communication path.

A positive braking (false alarm) which has been initiated by incorrect operation of the safety monitoring appliance SMA1 can be cancelled, if required, by a fault switch. The position of the fault switch is read through auxiliary contacts. The inserted fault switch is additionally indicated as a diagnosis message, to be precise typically on a driver's cab display Tf-MMI, which is likewise connected to the vehicle bus VB.

The fault switches for the various controllers are read redundantly and are evaluated by the appliances which can each demand a braking process for the rail vehicle when required. If, for example, an undesired demand for a braking process is still present from a specific controller because of a fault, for example in the safety monitoring appliance SMA1, the appliance SMA1 can be switched off.

Overall, a mode for the braking process or traction inhibit demanded in step b) (which is a safety reaction demanded by the appliance through a data bus) can be configured individually.

The invention claimed is:

1. A method for demanding safety reactions for a rail vehicle, the method comprising the following steps:

providing a plurality of appliances each configured to demand a safety reaction selected from a group consisting of a braking process, a traction inhibit and both a braking process and a traction inhibit for the rail vehicle when required;

providing a safety loop common to the plurality of appliances, the appliances each having a different function taken from the group of functions consisting of: emergency braking demanding by a passenger, bogie truck or wagon monitoring, dead-man function, braking controlling, door controlling, and speed monitoring;

providing a controller;

providing a data bus for interconnecting the plurality of appliances and the controller;

identifying, by one appliance of the plurality of appliances, a state in which one of the safety reactions should be carried out;

demanding, by the one appliance, the safety reaction from the controller over the data bus; and if the safety reaction has been carried out, feeding back information to the demanding one appliance that the safety reaction has been carried out, and if the safety reaction has not been carried out, intervening in the safety loop to initiate a desired safety reaction.

2. The method for demanding safety reactions according to claim 1, which further comprises carrying out the demanding step by normally demanding low-wear full braking in an event of a braking demand.

3. The method for demanding safety reactions according to claim 1, which further comprises carrying out the step of feeding back information by providing feedback through a measured pressure value for a main air line of the rail vehicle, when a braking process has been carried out.

4. The method for demanding safety reactions according to claim 1, which further comprises carrying out the step of feeding back information by feeding back a braking process being carried out or a traction inhibit being carried out through a train speed value to the demanding appliance.

5. The method for demanding safety reactions according to claim 1, which further comprises carrying out the step of feeding back information by feeding back a braking process being carried out through a braking control system or feeding back a traction inhibit being carried out through a drive control system to the demanding appliance.

6. The method for demanding safety reactions according to claim 1, which further comprises carrying out the step of feeding back information by defining a predefined time period from the demand for the safety reaction for the feedback of a braking process being carried out or a traction inhibit bring carried out, and carrying out the intervention in the safety loop if there is no feedback to the appliance within the predefined time period.

7. The method for demanding safety reactions according to claim 1, which further comprises carrying out the demanding step by bridging the demand for the braking process or the traction inhibit with the appliance, if required.

8. The method for demanding safety reactions according to claim 7, which further comprises bridging the braking demand with fault switches.

9. The method for demanding safety reactions according to claim 8, which further comprises redundantly reading the fault switches and evaluating the fault switches with the appliances each being configured to demand a braking process or a traction inhibit for the rail vehicle when required.

10. The method for demanding safety reactions according to claim 1, which further comprises switching off the appliance when a demand for a braking process or a traction inhibit by a specific appliance is not desired.

11. The method for demanding safety reactions according to claim 1, which further comprises individually projecting a mode of the braking process or a traction inhibit demanded in the demanding step.

* * * * *